US005959514A

United States Patent [19]

Smith et al.

[11] Patent Number: 5,959,514

[45] Date of Patent: Sep. 28, 1999

[54] COAXIAL TERMINATION ARRANGEMENT

[75] Inventors: Adrian David Smith, Devon, United Kingdom; Colin John Kellet, Victoria, Australia

[73] Assignee: Northern Telecom Limited, Montreal, Canada

[21] Appl. No.: 08/832,408

[22] Filed: Apr. 2, 1997

[30] Foreign Application Priority Data

Apr. 3, 1996 [GB] United Kingdom ..... 9607092

[51] Int. Cl.[6] ..... H01P 1/04

[52] U.S. Cl. ..... 333/260; 439/63

[58] Field of Search ..... 333/33, 260; 439/63, 439/581

[56] References Cited

U.S. PATENT DOCUMENTS

| | | | |
|---|---|---|---|
| 3,131,369 | 4/1964 | Kraus | 333/260 |
| 4,631,505 | 12/1986 | Schiavone | 333/33 |
| 5,394,119 | 2/1995 | Pleva et al. | 333/260 X |

FOREIGN PATENT DOCUMENTS

| | | | |
|---|---|---|---|
| 2-183601 | 7/1990 | Japan | 333/26 |

OTHER PUBLICATIONS

Evans, Annular Ring Coaxial Termination, IBM Technical Disclosure Bulletin, vol. 16, No. 10, pp. 3331, 3332, Mar. 1974.

*Primary Examiner*—Paul Gensler
*Attorney, Agent, or Firm*—John D. Crane

[57] ABSTRACT

A coaxial connector arrangement for transferring high frequency microwave signals between a coaxial cable and a further device is disclosed. In many present systems, the connector arrangement whereby microwave signals are passed from a coaxial cable to a device or the like at high frequencies has a tendency of radiating. Not only do the radiative emissions lose power, but this radiation can combine with the desired signals to form intermodulation products which further lose signal power and also distort the signal. The mating faces of the connector provide a malleable raised line portion which is disposed about the central conductor whereby a continuous line contact is defined on the mating components about the inner conductor, thereby preventing emission of high frequency signals which may interact with the intended signals.

4 Claims, 7 Drawing Sheets

COAXIAL TERMINATION ARRANGEMENT

FIELD OF THE INVENTION

This invention relates to a coaxial termination arrangement, such as a coaxial cable to microstrip arrangement.

BACKGROUND TO THE INVENTION

Coaxial cable is widely employed in system configuration, where microwave and radio signals are processed. A typical use of a coaxial to planar substrate transition is in a mobile communications network base station where receive and transmit electronics are connected to a triplate or layered antenna by way of a coaxial cable. One form of triplate antenna comprises a microstrip feed network printed on a dielectric film or substrate which provides the feed probes or patches which extend into or are arranged within radiating apertures defined through the outermost groundplane of the triplate antenna. In such an arrangement, the central conductor of a coaxial cable is soldered directly to the microstrip circuit of the antenna. The axis of the central conductor can either be in-line or orthogonal with respect to the substrate and the earthed sheath is connected to the groundplanes of the antenna. Alternatively, the microstrip array may be formed upon a printed circuit board manufactured from a substance such as PTFE. U.S. Pat. No. 4,918,458 (Ford Aerospace) describes such an antenna arrangement which is fed by way of a coaxial supply cable.

These types of configuration, whilst easy to manufacture can suffer from the generation of passive intermodulation products. Power handling capabilities can be limited since high losses will result from the isolating distances necessary from the coaxial transition section to any power dividers such as Wilkinson couplers. Further problems arise in the use of the dielectrics having high temperature capabilities necessary in order to allow solder connections to be made. Coupled lines can be present in order to provide a d.c. block in cases such as active antennas.

In the design of mechanical connections with microwave conductors, extreme care needs to be exercised for critical applications requiring high linearity, for example, cellular radiocommunications and satellite communications. In the case where components are welded or soldered, attention needs to be paid to the electrical conductor's surface; irregularities and imperfect metal to metal contacts lead to electrical non-linearities. This introduces passive intermodulation, in which deleterious, spurious signals are generated and, generally, these effects vary with frequency, contact pressure, age and other factors.

OBJECT OF THE INVENTION

The present invention seeks to provide an improved coaxial cable connection with high mean or peak power handling and very low passive intermodulation product generation.

SUMMARY OF THE INVENTION

In accordance with one aspect of the invention, there is provided a coaxial termination arrangement for transferring high frequency microwave signals between a coaxial conductor and a further device, the termination arrangement comprising: a ground abutment portion associated with the conductor, and a ground abutment portion associated with the further device; which abutment portions surround but do not contact their respective central conductors: wherein the ground connection is effected by compression of a raised annular malleable member which is disposed around the central conductor whereby a continuous line contact of the mating components is defined around the inner conductor, thereby preventing a spurious emission of high frequency signals which may interact with the intended signals.

The conductor can be a coaxial cable, and can be rigid, semi-rigid or flexible. The further device can be a coaxial cable. Alternatively, the raised annular malleable member can be a separate element which is inserted into a recess of a first abutment portion.

In accordance with another aspect of the invention, there is provided a method of transferring microwave signals between a coaxial conductor and a further device, said coaxial conductor comprising a central conductor and a grounded sheath; the method comprising: providing microwave signals to a central conductor of a coaxial conductor, the ground potential being maintained from the grounded sheath through a ground abutment portion associated with the coaxial conductor and to a ground abutment portion associated with the further device, which abutment portions surround but do not contact their respective central conductors; the central conductor being directly connected with a central conductor associated with the further device: wherein the ground connection is effected by compression of a raised annular malleable member which is disposed around the central conductor whereby a continuous circumferential contact of the mating components is defined around the inner conductor, thereby providing a continuous ground potential about the central conductor whereby preventing a spurious emission of high frequency signals which may interact with the intended signals.

BRIEF DESCRIPTION OF THE DRAWINGS

Embodiments of the invention will now be described with reference to the accompanying drawings, in which.

DETAILED DESCRIPTION OF PREFERRED EMBODIMENTS

Figure 1:
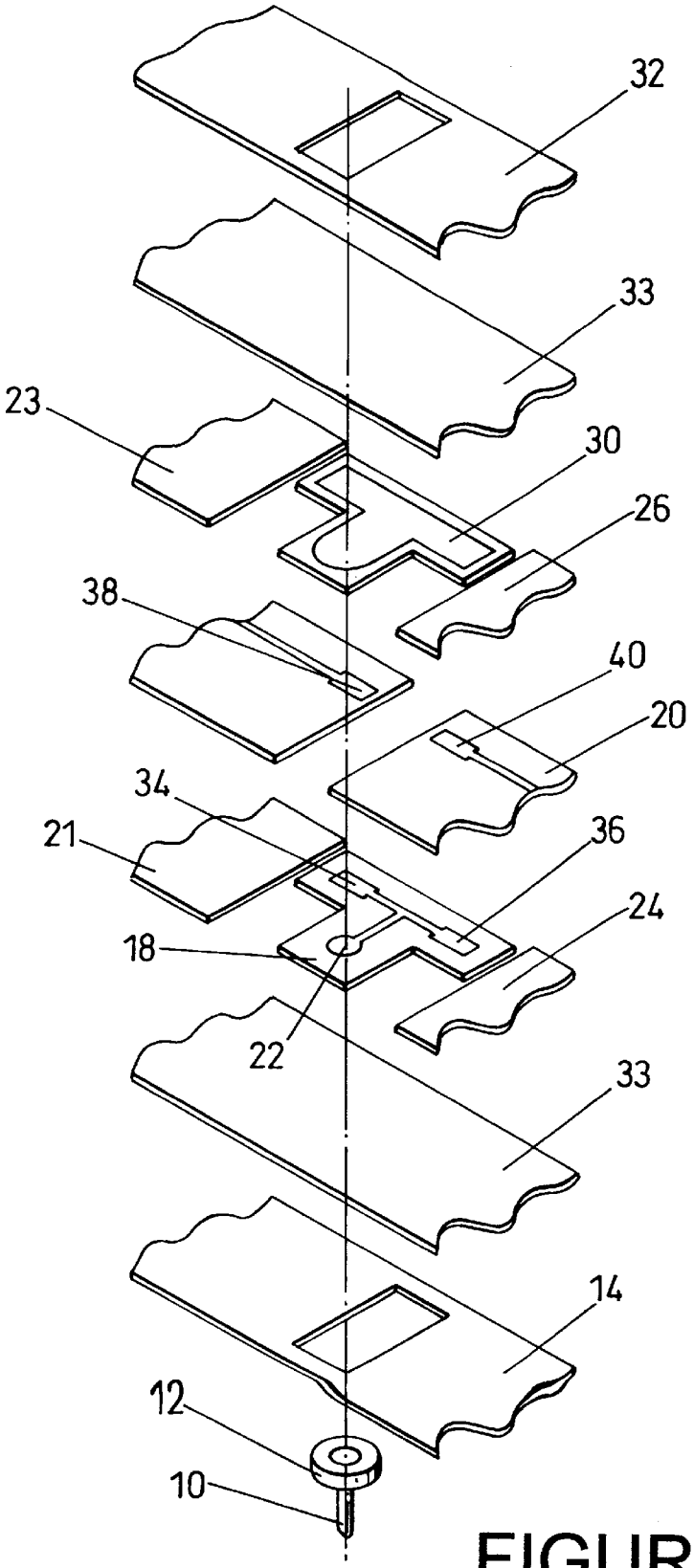
FIG. 1 shows a first embodiment of the invention.

Referring now to FIG. 1, there is shown a first arrangement in accordance with the invention wherein a coaxial cable 10 having a ground connection transition body 12 is attached to a first ground plane 14 of the triplate structure. The inner conductor of the coaxial cable is connected to a transitional dielectric substrate 18 having a microstrip circuit printed thereon, arranged in a 'T' layout on the surface opposite the first ground plane 14. A thin dielectric 20 supports a microstrip layout for the triplate structure. The dielectric 20 has a cut-out portion corresponding to the area of the solder joint 22 effected on the transition portion 18 from the inner conductor of the coaxial cable. The microstrip network is printed on the side of the dielectric facing away from the first groundplane 14. Dielectric layers such as foam layers 24,26 are placed either side of dielectric 20, around the transition board 18 and around the optional secondary transition board 30. Optional transition board 30 serves to prevent the solder from contacting with a second ground plane 32. The microstrip patch elements 34, 36 of the transition board 18 capacitively couple with microstrip elements 38, 40 of the microstrip network on dielectric 20.

Figure 2:
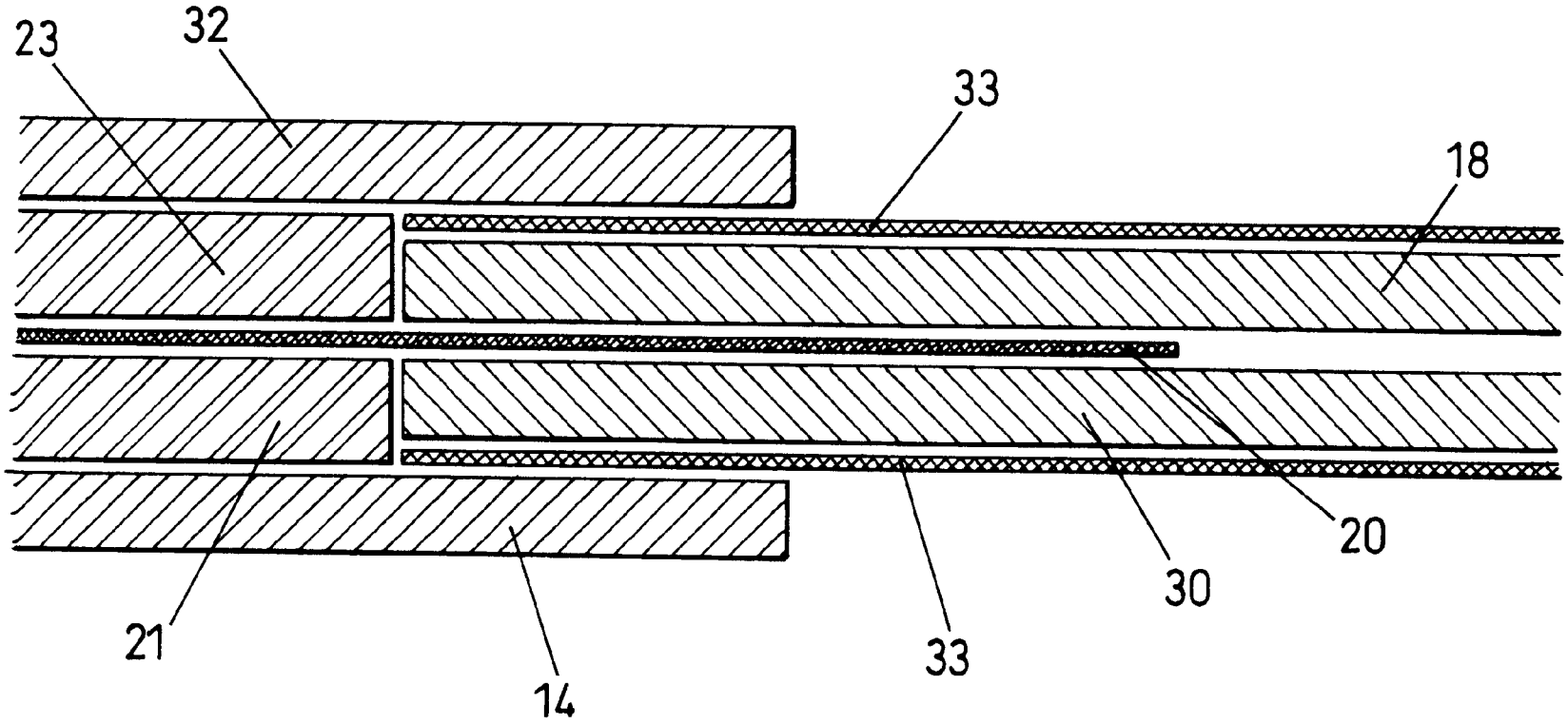
FIG. 2 details the first embodiment in section.

FIG. 2 details the sections of the embodiment shown in FIG. 1, but does not detail coaxial cable 10 and transition body 12. The triplate structure is defined by two metal plates 14, 32 made from, for example, aluminum alloy. A dielectric film 20 supports a microstrip pattern, which film is supported between two layers of high density foam 21, 23 whereby optimum distances between the film 20 and the metallic plates of the triplate structure are maintained. The intermediate boards of the transition arrangement 18, 30 lie either side of the dielectric film 20, whilst a plastic sheet such as polyester 33 isolates the ground plane of the intermediate board 18 from the ground plane 14 and 32 of the triplate structure and the grounding effect is thus reactively coupled.

Figure 3:
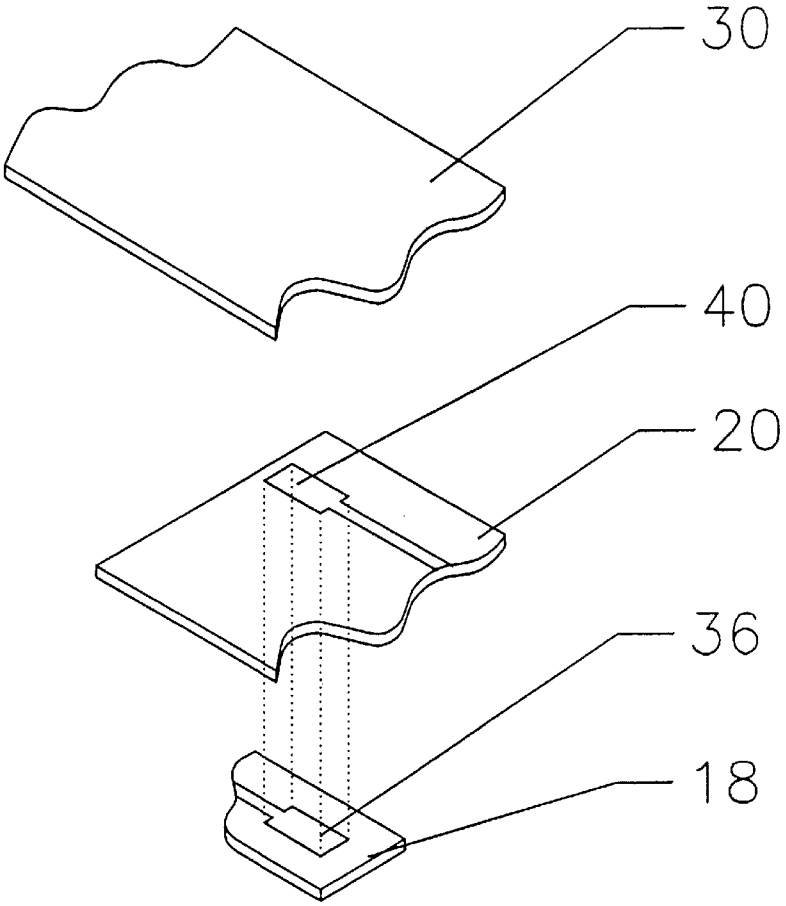
FIG. 3 shows the relative positions of coupled portions.

FIG. 3 details, in a perspective spaced-apart relationship, the intermediate boards 18, 30 of the transition arrangement. The dielectric film 20 having a metallised track with a coupling patch 40 on a first side is positioned with its second side against the intermediate board 18. Coupling patch 40 is arranged opposite a similarly shaped metallised patch 36 of the microstrip pattern on the intermediate board 18 to ensure optimum coupling—although the coupling region may in fact be no more than a portion of metallised line. Conveniently, the microstrip line from the coaxial cable divides into two probes, which probes separately couple with corresponding patches on the polyester film since the power can be easily split between the two arms without excessive power loss due to reflections. Alternatively, the two arms from the coaxial feed point can feed a Wilkinson divider, whereby four coupling patches may couple with corresponding patches on the polyester film.

Figure 4:
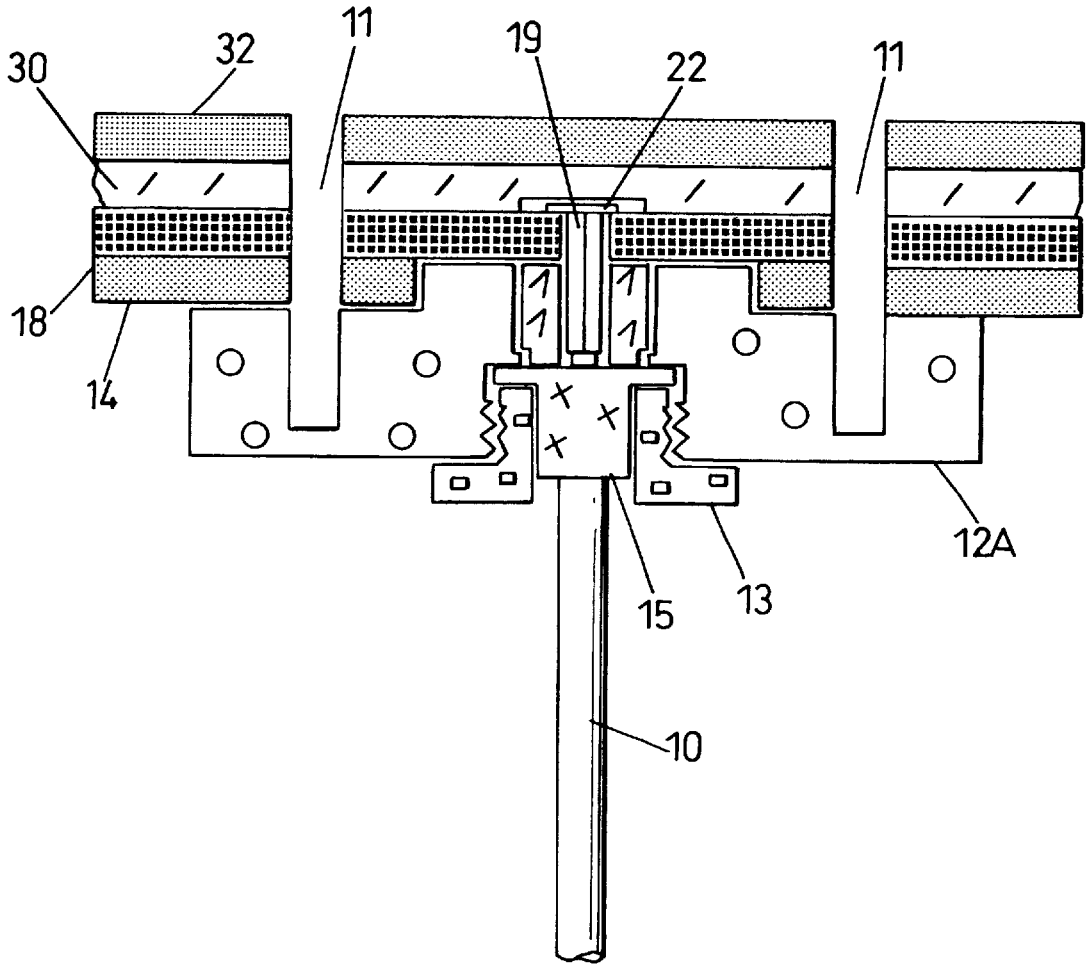
FIG. 4 shows a first coaxial termination element.

One form of coaxial termination is shown in FIG. 4, and depicts the relative positions, albeit not to scale, of coupled portions of a further embodiment, in the region where the intermediate board portions overlap. In this example, a connector-socket 12A is positioned within a recess of ground plane 14. Drilled and tapped holes 11 are arranged to accept bolts (not shown) which fasten the arrangement to a triplate structure 14,18,30 & 32. Alternatively, the bolts may be self tapping. A female contact 19 is soldered to the board and to the microstrip tracks. This contact has a split sleeve configuration which can engage a central conductor of a coaxial cable in a sliding contact fashion, which can accomodate movement due to thermal expansion and other effects. A solder joint 22 connects the central conductor of coaxial cable 10 with a microstrip or stripline track. The central portion of the connector has a recess which is internally threaded at the entrance and an abutment portion, the abutment portion being shaped to abut against a ferrule 15 associated with the end of a coaxial cable upon connection of screw-threaded bolt 13.

Figure 5:
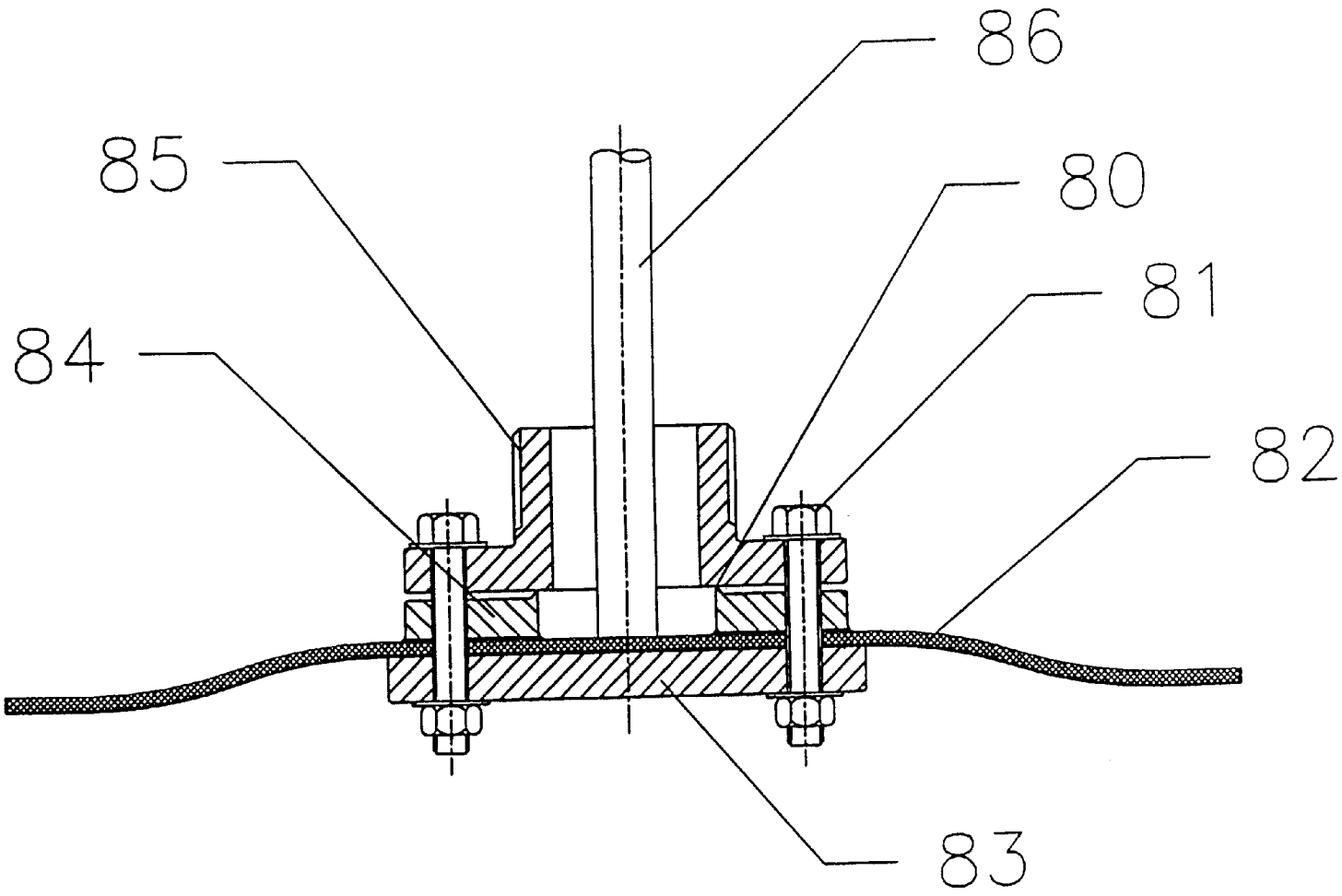
FIG. 5 shows a second coaxial termination element.

FIG. 5 shows a second type of coaxial cable to stripline/microstrip configuration having bolts 81 which attach the connector to the dielectric structure 82 (which can be flexible). The abutment portion 84 has a circumferential line or edge contact or malleable annular member 80, which edge is compressed upon abutment with the other ferrule or abutment portion 85. The ferrule 85 could possess the circumferential line or edge contact arrangement. Alternatively, the raised malleable annular member can be a separate element which is inserted into a recess of the first abutment portion. Reference numeral 86 indicates a coaxial connection; reference numeral 83 indicates parts of the connector structure on the other side of the dielectric to keep open portions 84, 85 and to which the abutment portions 84, 85 are connected by means of bolts 81.

Figure 6:
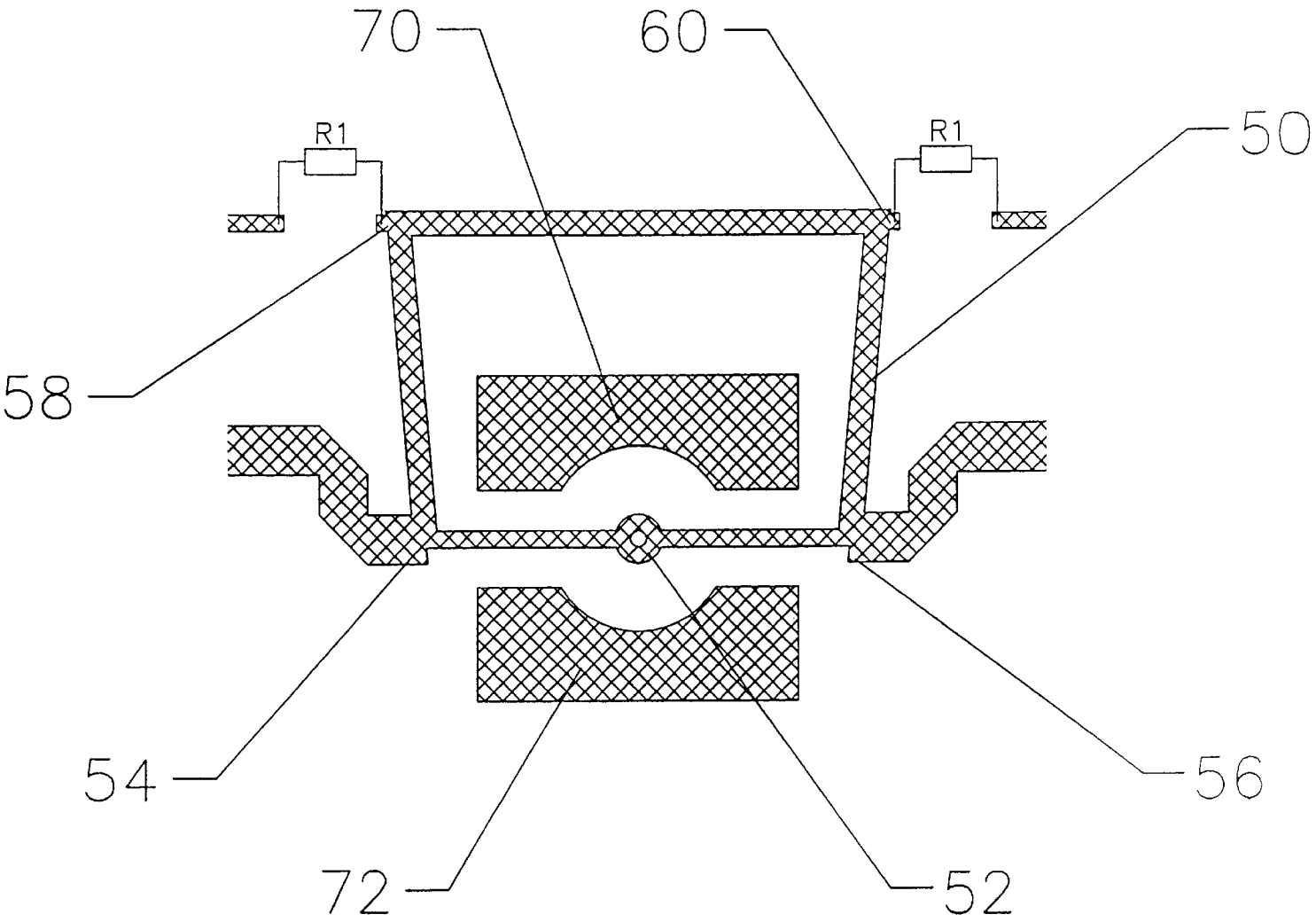
FIG. 6 shows a rat-race-coupling arrangement.

FIG. 6 details a second type of microstrip circuit for the transition section 18, comprising a balanced five port rat-race circuit element 50, wherein one of the nodes 52 of the rat-race is the coaxial-solder transition. The nodes or ports 54, 56 either side of the input node 52 act as output ports which can feed couplers such as Wilkinson couplers (not shown) which enable power to be divided or combined with respect to the output arms. Thus, using two Wilkinson couplers, four coupled portions can be provided from the arrangement. This is a compact coupling arrangement, which is especially useful in microstrip antenna arrangements. Metallised portions 70, 72 act to confine the microwave propagation along the ratrace rather than between the microstrip lines and the ground plane in a parasitic and lossy fashion. Terminating resistors R1, R2 are preferably placed at the unused ports of the rat-race, as is well known. A grounded area can be provided on the same side as the microstrip pattern to aid parasitic mode suppression. Such a grounded area can be readily fabricated by appropriate metallisation and extending vias from the earth plane on the other side of the intermediate board, and/or by metallising around the edge of the substrate.

Figure 7:
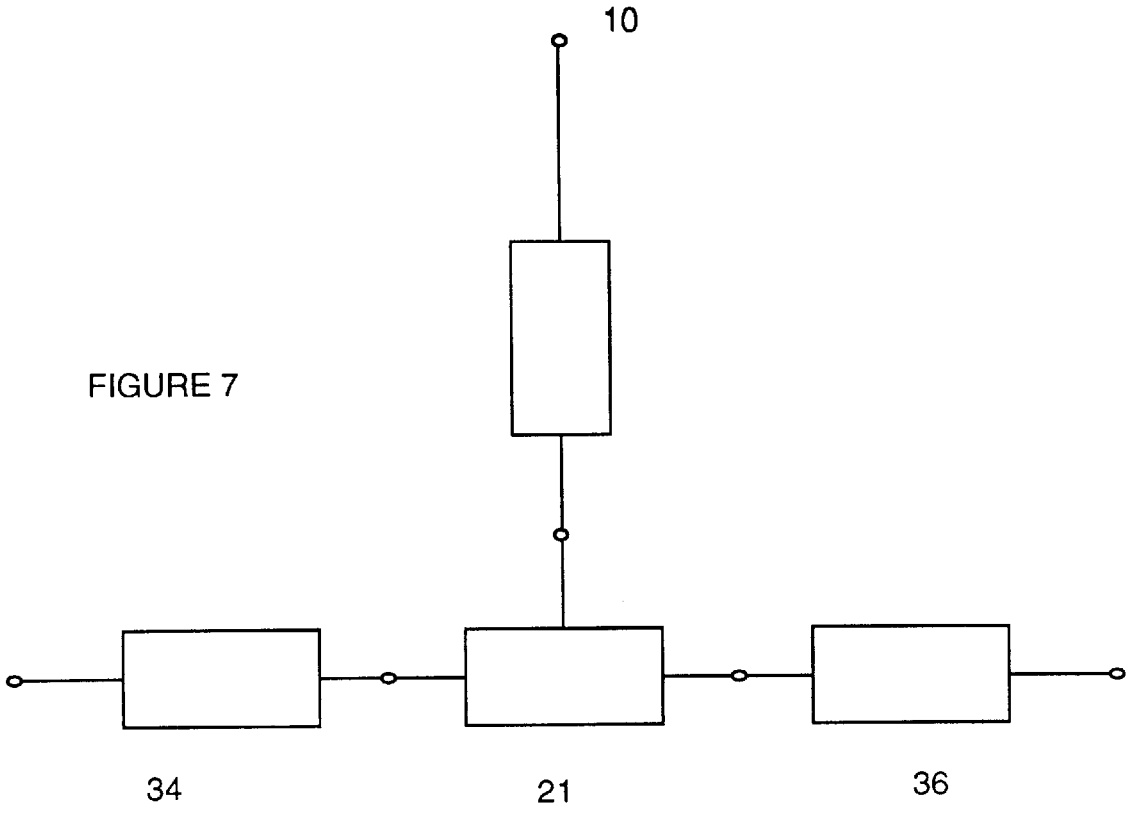
FIGS. 7 and 8 demonstrate the equivalence of the embodiments.
Figure 8:
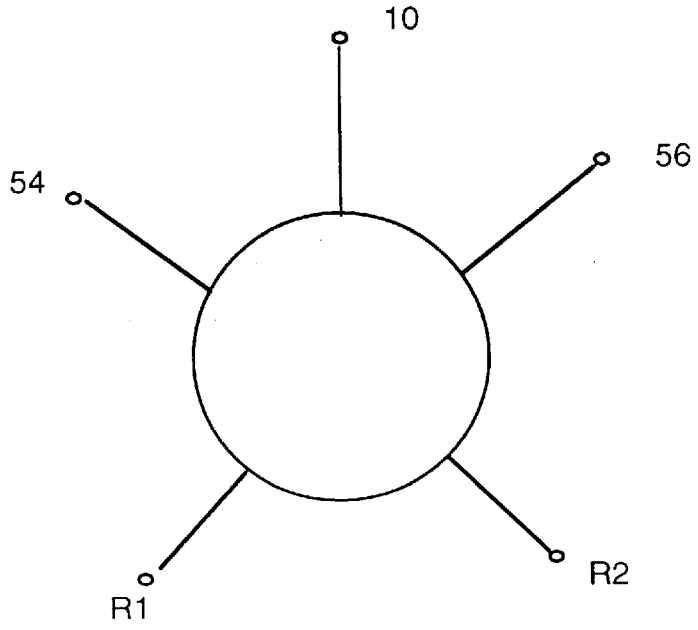

FIGS. 7 and 8 show the equivalence of the two forms of coupling arrangements as shown in FIGS. 1 and 6. The rat-race is internally matched to reduce losses and by having an in-phase splitter, the ports are in-phase. The microstrip portion 70 is preferably connected to the rat-race by a resistive element to avoid over-moding. Note also that instead of feeding two Wilkinson couplers, the two ports from the rat-race could feed the two input arms of a Wilkinson coupler to provide a single output.

By providing a reactively coupled connection, direct contact between dissimilar metals is reduced, thus reducing a source of inter-modulation noise and non-linearities. Preferably, through the use of silver plated components, fluxless solder and the use of solder reflow techniques where appropriate, noise generation is further reduced.

In order to keep manufacturing costs to a minimum the transition body can be a simple turned part and incorporate a slot in the mating face. An aluminum alloy can be used since it can provide a lightweight corrosion resistant component. This slot can allow self tapping screws to be used to fasten the transition body to the transition board assembly. This feature has two advantages: firstly, alignment is only necessary in one coordinate direction between the fixing holes in the transition board assembly and the transition body, and secondly, the transition body is cheap to manufacture as it avoids the need for costly tapped holes for fixing screws.

The female contact soldered to the transition board allows the centre conductor of the semi-rigid cable to slide within it thus avoiding mechanical stress during thermal expansion of the cable and the use of existing well proven connector parts within the transition assures very low intermodulation product generation. The microstrip patterns can be formed from copper and the substrate upon which the tracks are supported can be polyester, both of which being commonly used for such purposes.

The transition board is preferably manufactured from PTFE, which when metallised can provide a solderable substrate for the female contact in the transition. PTFE has a relatively high melting point which lends itself readily to soldering. The use of PTFE is preferable to that of a foam/film/foam sandwich for triplate since the PTFE can better accomodate high powers, is of low loss and, further, PTFE exhibits a better thermal conductivity than foam/film/foam. The assembly can thus handle relatively high powers and operate within an acceptable temperature range.

The coaxial cable may be rigid, semi-rigid or flexible. The ground planes shown may be formed from aluminum alloy, which offers a good strength to weight ratio and is highly corrosion resistant.

We claim:

1. A coaxial cable termination arrangement for transferring high frequency microwave signals between a coaxial cable having a central conductor and a further microwave device comprising a dielectric circuit board having a central conductor and a ground plane, the termination arrangement comprising:

a ground abutment portion associated with the coaxial cable central conductor, and a ground abutment portion associated with the ground plane of the further device;

which abutment portions surround but do not contact their respective central conductors:

wherein the ground connection is effected by compression of a raised annular malleable portion associated with one of the ground abutment portions against the other ground abutment portion which is disposed around the central conductor whereby a continuous line contact of the mating ground abutment portions is defined around the central conductor, thereby preventing a spurious emission of high frequency signals which may interact with the intended signals.

2. A coaxial termination arrangement according to claim 1, wherein the coaxial cable is a rigid coaxial cable.

3. A coaxial termination arrangement according to claim 1, wherein the coaxial cable conductor is a semi-rigid coaxial cable.

4. A method of transferring microwave signals between a coaxial cable and a further microwave device comprising a dielectric circuit board having a central conductor and a ground plane, said coaxial cable comprising a central conductor and a grounded sheath; the method comprising:

providing microwave signals to the central conductor of the coaxial cable, the ground potential being maintained from the grounded sheath through a ground abutment portion associated with the coaxial cable and to a ground abutment portion associated with the ground plane of the further device, which abutment portions surround but do not contact their respective central conductors; the central conductor coaxial cable being directly connected with the central conductor associated with the further device:

wherein the ground connection is effected by compression of a raised annular malleable portion associated with one of the ground abutment portions against the other ground abutment portion which is disposed around the central conductor whereby a continuous circumferential contact of the mating ground abutment portions is defined around the central conductor, thereby providing a continuous ground potential about the central conductor, thereby preventing a spurious emission of high frequency signals which may interact with the intended signals.

* * * * *